US008894813B2

(12) United States Patent
Zwick et al.

(10) Patent No.: US 8,894,813 B2
(45) Date of Patent: Nov. 25, 2014

(54) ABSORBENT BARRIER TISSUE

(75) Inventors: Kenneth John Zwick, Neenah, WI (US); Peter Lee Carson, Appleton, WI (US); Gary Lee Shanklin, Fremont, WI (US); Michael William Smaby, Neenah, WI (US); Michael John Rekoske, Appleton, WI (US); Thomas Joseph Dyer, Neenah, WI (US); Mike Thomas Goulet, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/588,151

(22) Filed: Aug. 17, 2012

(65) Prior Publication Data

US 2014/0048224 A1 Feb. 20, 2014

(51) Int. Cl.

| | |
|---|---|
| ***B31F 1/12*** | (2006.01) |
| ***D21H 27/40*** | (2006.01) |
| ***D21H 27/00*** | (2006.01) |
| ***D21H 17/35*** | (2006.01) |

(52) U.S. Cl.

CPC ..... *D21H 27/002* (2013.01); *D21H 17/35* (2013.01)

USPC ..... 162/111; 162/125; 162/149; 162/168.1; 162/169; 428/153; 428/172; 428/340

(58) Field of Classification Search

CPC ... D21H 27/002; D21H 21/146; D21H 21/18; D21H 21/20; D21H 17/35; D21H 27/005; D21H 27/30; D21H 27/40; D21H 27/32; D21H 27/36; A47K 10/16; B32B 5/22

USPC ..... 162/111–113, 123–133, 158, 168.1, 162/169; 428/152–154, 172, 340

See application file for complete search history.

(56) References Cited

U.S. PATENT DOCUMENTS

| | | | | |
|---|---|---|---|---|
| 3,879,257 | A | 4/1975 | Gentile et al. | |
| 4,158,594 | A | 6/1979 | Becker et al. | |
| 4,166,001 | A | 8/1979 | Bicho et al. | |
| 4,574,021 | A | 3/1986 | Endres et al. | |
| 4,816,320 | A | 3/1989 | St. Cyr | |
| 4,950,545 | A * | 8/1990 | Walter et al. | 428/446 |
| 5,164,046 | A | 11/1992 | Ampulski et al. | |
| 5,730,839 | A | 3/1998 | Wendt et al. | |
| 5,830,317 | A | 11/1998 | Vinson et al. | |
| 5,846,380 | A | 12/1998 | Van et al. | |
| 5,968,853 | A | 10/1999 | Kelly et al. | |
| 5,981,044 | A | 11/1999 | Phan et al. | |
| 6,054,020 | A | 4/2000 | Goulet et al. | |
| 6,162,327 | A | 12/2000 | Batra et al. | |
| 6,241,850 | B1 | 6/2001 | Kelly | |
| 6,332,952 | B1 * | 12/2001 | Hsu et al. | 162/127 |
| 6,454,901 | B1 | 9/2002 | Sekiya et al. | |
| 6,517,678 | B1 | 2/2003 | Shannon et al. | |
| 6,656,569 | B1 | 12/2003 | Roussel et al. | |
| 6,797,114 | B2 | 9/2004 | Hu | |
| 6,821,387 | B2 | 11/2004 | Hu | |
| 6,861,380 | B2 | 3/2005 | Garnier et al. | |
| 7,029,756 | B2 * | 4/2006 | Moline et al. | 428/452 |
| 7,517,433 | B2 * | 4/2009 | Zwick et al. | 162/109 |
| 7,785,443 | B2 * | 8/2010 | Hermans et al. | 162/168.1 |
| 7,803,249 | B2 | 9/2010 | Dyer et al. | |
| 7,807,023 | B2 * | 10/2010 | Dyer et al. | 162/168.1 |
| 7,879,190 | B2 | 2/2011 | Dyer et al. | |
| 7,883,604 | B2 | 2/2011 | Dyer et al. | |
| 8,025,764 | B2 * | 9/2011 | Bhat et al. | 162/117 |
| 8,070,913 | B2 * | 12/2011 | Salaam et al. | 162/123 |
| 8,123,905 | B2 | 2/2012 | Luu et al. | |
| 2003/0121627 | A1 | 7/2003 | Hu et al. | |
| 2003/0131960 | A1 * | 7/2003 | McConnell et al. | 162/127 |
| 2003/0192662 | A1 * | 10/2003 | Heath et al. | 162/111 |
| 2004/0086726 | A1 * | 5/2004 | Moline et al. | 428/447 |
| 2004/0163785 | A1 * | 8/2004 | Shannon et al. | 162/158 |
| 2004/0250969 | A1 * | 12/2004 | Luu et al. | 162/123 |
| 2006/0042767 | A1 * | 3/2006 | Bhat et al. | 162/117 |
| 2006/0243405 | A1 * | 11/2006 | Zwick et al. | 162/135 |
| 2007/0137810 | A1 * | 6/2007 | Dyer et al. | 162/109 |
| 2008/0135195 | A1 * | 6/2008 | Hermans et al. | 162/135 |
| 2008/0187733 | A1 | 8/2008 | Abbosh et al. | |
| 2009/0188637 | A1 * | 7/2009 | Chan et al. | 162/112 |
| 2010/0155004 | A1 | 6/2010 | Wang et al. | |
| 2010/0212849 | A1 * | 8/2010 | Smith et al. | 162/111 |
| 2010/0224338 | A1 * | 9/2010 | Harper et al. | 162/132 |
| 2010/0319864 | A1 * | 12/2010 | Bhat et al. | 162/109 |
| 2011/0198776 | A1 | 8/2011 | Sekiya et al. | |
| 2011/0303374 | A1 * | 12/2011 | Chan et al. | 162/112 |
| 2011/0303375 | A1 | 12/2011 | Shannon et al. | |
| 2012/0125552 | A1 * | 5/2012 | Goulet et al. | 162/112 |
| 2012/0164200 | A1 * | 6/2012 | Qin et al. | 424/402 |
| 2012/0255694 | A1 * | 10/2012 | Druecke et al. | 162/111 |
| 2014/0050889 | A1 * | 2/2014 | Zwick et al. | 428/152 |
| 2014/0050890 | A1 * | 2/2014 | Zwick et al. | 428/154 |

FOREIGN PATENT DOCUMENTS

| | | | |
|---|---|---|---|
| EP | 0 144 658 | A1 | 6/1985 |
| EP | 1 112 177 | B1 | 2/2012 |
| GB | 2 006 296 | A | 5/1979 |
| WO | WO 9840207 | A1 * | 9/1998 |
| WO | WO 2008/003343 | A1 | 1/2008 |
| WO | WO 2012137102 | A2 * | 10/2012 |

* cited by examiner

*Primary Examiner* — Jose Fortuna

(74) *Attorney, Agent, or Firm* — Kimberly-Clark Worldwide, Inc.

(57) ABSTRACT

In general, the present disclosure is directed to creped tissue webs, and products produced therefrom. The creped webs and products are strong, soft, and have improved strike-through and absorbency properties. The improvement in both strike-through and absorbency is achieved in-part by increasing the basis weight of the web, while at the same time reducing the creping composition add-on levels.

16 Claims, 2 Drawing Sheets

ABSORBENT BARRIER TISSUE

BACKGROUND

Facial tissue needs to absorb nasal discharge to prevent the discharge from contacting the user's hand. It is also desirable that the tissue prevent strike-through—that is the absorbed discharge permeating through the tissue to the user's hand. Although both absorbency and strike-through prevention are desirable, optimizing one typically occurs at the expense of the other.

To better balance absorbency and strike-through prevention tissue manufacturers typically post-treat the tissue product. Post-treatment typically involves the application of a hydrophobic material such as a silicone, a wax or oil. While such treatments often balance absorbency and strike-through, they are expensive, require an additional application step, and may transfer a residue to the user's skin. Therefore, there is a need for a tissue that has both high absorbency and good strike-through without resorting to post-treatment with hydrophobic materials.

SUMMARY

The inventors have now surprisingly discovered that the absorbent capacity of a tissue may be increased, without negatively effecting strike-through, by increasing the basis weight and reducing creping chemistry add-on. While increasing the basis weight generally has little or no effect on strike-through resistance, it has now been discovered that increasing basis weight and employing certain creping conditions may actually improve strike-through resistance and enable a reduction in the amount of creping composition added to the sheet. Reducing the amount of creping composition, in combination with the higher basis weight, yields a tissue having both improved strike-though resistance and absorbency. Moreover, these attributes are achieved without resorting to post-treating the tissue with silicones, waxes, oils or the like.

Accordingly, in one aspect the present disclosure provides a creped tissue product comprising two or more tissue webs, wherein the basis weight of each web is greater than about 16 grams per square meter (gsm) and the product has a strike-through greater than about 2 seconds (sec.) and an absorbent capacity greater than about 27 grams (g).

In still other aspects the present disclosure provides a multi-ply tissue product comprising two multi-layered creped tissue webs, the tissue webs having three superposed layers, an inner layer consisting essentially of softwood fibers and two outer layers consisting essentially of hardwood fibers, the inner layer being located between the two outer layers, wherein each web has a basis weight of at least about 16 gsm and the product has a strike-through greater than about 2 seconds and an absorbent capacity greater than about 27 grams.

In still other aspects the disclosure provides a tissue product comprising at least two creped tissue webs, each web having a first side and a second side and a creping composition comprising a non-fibrous olefin polymer disposed on at least the first side, wherein each tissue web has a basis weight of at least about 16 gsm and the product has a strike-through greater than about 2 seconds and an absorbent capacity greater than about 27 grams.

Other features and aspects of the present disclosure are discussed in greater detail below.

DEFINITIONS

Figure 1:
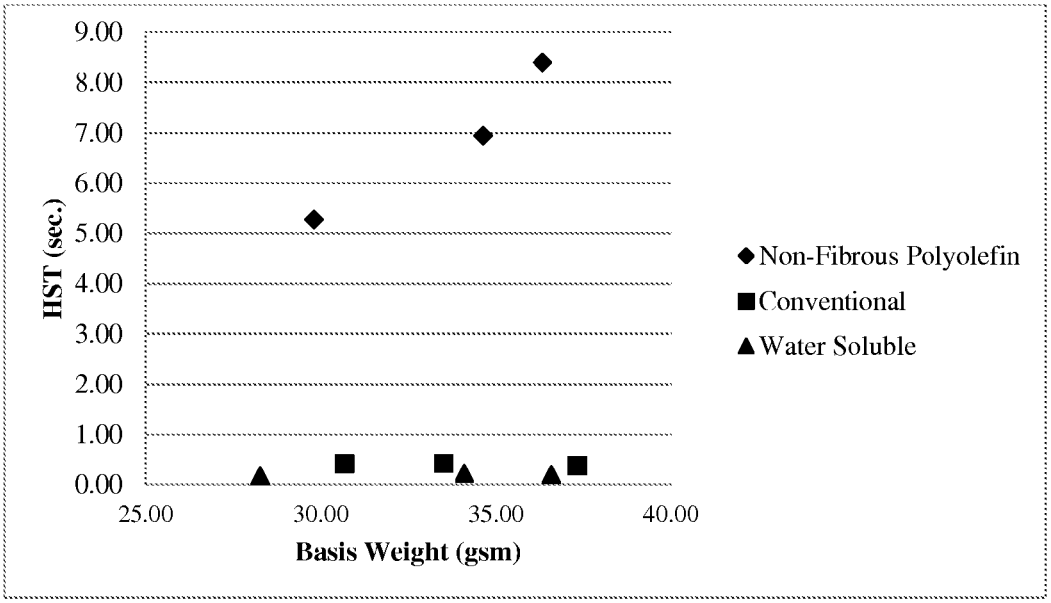
FIG. 1 is a comparison of basis weight (x-axis, grams per square meter) and strike-through (y-axis, seconds) for three different creping chemistries.

As used herein, the terms "strike-through" and "strike-through resistance" refer to the ability of a tissue product or ply to prevent the passage of water or other liquid through its thickness. Strike-through is measured herein using the Hercules Size Test (HST), which is described in the test methods section herein.

As used herein, the term "tissue product" refers to products made from base webs comprising fibers and includes, bath tissues, facial tissues, paper towels, industrial wipers, food-service wipers, napkins, medical pads, and other similar products.

As used herein, the terms "tissue web" and "tissue sheet" refer to a cellulosic web suitable for use in a tissue product.

As used herein the term "basis weight" generally refers to the conditioned weight per unit area of a tissue and is generally expressed as grams per square meter (gsm). Basis weight is measured herein using TAPPI test method T-220.

DETAILED DESCRIPTION

In general, the present disclosure is directed to creped tissue webs, and products produced therefrom. The creped webs and products are strong, soft, and have improved strike-through resistance and absorbency. The improvement in both strike-through resistance and absorbency is achieved in-part by increasing the basis weight of the web, while at the same time reducing the creping composition add-on levels. While increasing basis weight alone generally does not improve strike-through resistance, increased basis weight surprisingly improves creping performance, allowing for the application of less creping composition to the web. In this manner the inventors have arrived at webs that have improved strike-through resistance and absorbency, yet are strong and soft. Accordingly, in certain embodiments the disclosure provides a creped tissue web having a basis weight of at least about 16 gsm, a strike-through greater than about 2 seconds and an absorbent capacity greater than about 27 grams.

In one embodiment, the tissue webs are creped, wherein the creping composition comprises a thermoplastic resin, such as the composition disclosed in U.S. Pat. No. 7,807,023, which is incorporated herein in a manner consistent with the present disclosure. The thermoplastic resin may be contained, for instance, in an aqueous dispersion prior to application to the creping surface. In one particular embodiment, the creping composition may comprise a non-fibrous olefin polymer. The creping composition, for instance, may comprise a film-forming composition and the olefin polymer may comprise an interpolymer of ethylene and at least one comonomer comprising an alkene, such as 1-octene. The creping composition may also contain a dispersing agent, such as a carboxylic acid. Examples of particular dispersing agents, for instance, include fatty acids, such as oleic acid or stearic acid.

In one particular embodiment, the creping composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

The olefin polymer composition may exhibit a crystallinity of less than about 50 percent, such as less than about 20 percent. The olefin polymer may also have a melt index of less than about 1000 g/10 min, such as less than about 700 g/10 min. The olefin polymer may also have a relatively small particle size, such as from about 0.05 micron to about 5 microns when contained in an aqueous dispersion.

In an alternative embodiment, the creping composition may contain an ethylene-acrylic acid copolymer. The ethylene-acrylic acid copolymer may be present in the creping composition in combination with a dispersing agent, such as a fatty acid.

Once applied to a tissue web, it has been discovered that the creping composition may form a discontinuous film depending upon the amount applied to the web. In other embodiments, the creping composition may be applied to a web such that the creping composition forms discrete treated areas on the surface of the web.

Accordingly, in certain embodiments the disclosure provides a creped tissue product, wherein the product has a basis weight of at least about 30 gsm, and more preferably at least about 32 gsm, such as from about 32 to about 50 gsm. The tissue products preferably have an absorbent capacity of at least about 25 g and more preferably at least about 27 g and still more preferably at least about 28 g, such as from about 27 to about 35 g. Further, tissue products having improved absorbent capacity and increased basis weight preferably have increased strike-through resistance, such as HST values of greater than about 2 seconds and more preferably greater than about 5 seconds, such as from about 5 to about 10 seconds.

In this manner, tissue webs and products prepared according to the present disclosure generally have improved absorbent capacity and strike-through compared to prior art tissues, as illustrated in Table 1. Further, the improved absorbent capacity and strike-through are achieved without post-treatment of the web.

TABLE 1

| Sample | Post Treated | Plies (No.) | Basis Weight (gsm) | Absorbent Capacity (g) | HST (sec.) | Wet Out Time (sec.) |
|---|---|---|---|---|---|---|
| Kleenex ® Facial Tissue | N | 2 | 28.27 | 26.78 | 10.4 | 51 |
| Kleenex Ultra Soft ® Facial Tissue | Y | 3 | 43.63 | 46.07 | 31.4 | 144 |
| Puffs Basic ® Facial Tissue | N | 2 | 29.82 | 56.41 | 1.1 | 6.3 |
| Puffs Plus ® Facial Tissue | Y | 2 | 42.79 | 38.36 | 44 | 90 |
| Puffs Ultra Strong and Soft ® Facial Tissue | Y | 2 | 40.03 | 52.07 | 3.5 | 68 |
| Publix ® Facial Tissue | N | 2 | 32.62 | 37.86 | 0.3 | 2.7 |
| Up&Up ™ Everyday Facial Tissue | N | 2 | 30.75 | 34.03 | 0.3 | 2.2 |
| Scotties ® 2-Ply Facial Tissue | N | 2 | 31.34 | 35.47 | 0.4 | 3.1 |
| Scotties ® 3-Ply Facial Tissue-U.S. | N | 3 | 47.79 | 46.99 | 0.5 | 3.8 |
| Inventive Sample | N | 2 | 33.29 | 30.59 | 2.79 | 36 |
| Inventive Sample | N | 2 | 34.63 | 29.07 | 6.94 | 86 |

In general, any suitable fibrous web may be treated in accordance with the present disclosure. For example, in one aspect, the base sheet can be a tissue product, such as a bath tissue, a facial tissue, a paper towel, a napkin, and the like. Fibrous products can be made from any suitable types of fiber. Fibrous products made according to the present disclosure may include single-ply fibrous products or multiple-ply fibrous products. For instance, in some aspects, the product may include two plies, three plies, or more.

Fibers suitable for making fibrous webs comprise any natural or synthetic fibers including both nonwoody fibers and woody or pulp fibers. Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. Nos. 4,793,898, 4,594,130, 3,585,104. Useful fibers can also be produced by anthraquinone pulping, exemplified by U.S. Pat. No. 5,595,628.

The fibrous webs of the present disclosure can also include synthetic fibers. For instance, the fibrous webs can include up to about 10 percent, such as up to about 30 percent or up to about 50 percent or up to about 70 percent or more by dry weight, to provide improved benefits. Suitable synthetic fibers include rayon, polyolefin fibers, polyester fibers, bicomponent sheath-core fibers, multi-component binder fibers, and the like. Synthetic cellulose fiber types include rayon in all its varieties and other fibers derived from viscose or chemically-modified cellulose.

Chemically treated natural cellulosic fibers can be used, for example, mercerized pulps, chemically stiffened or crosslinked fibers, or sulfonated fibers. For good mechanical properties in using web forming fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable web forming fibers can also include recycled fibers, virgin fibers, or mixes thereof.

In general, any process capable of forming a web can also be utilized in the present disclosure. For example, a web forming process of the present disclosure can utilize creping, wet creping, double creping, recreping, double recreping, embossing, wet pressing, air pressing, through-air drying, hydroentangling, creped through-air drying, co-forming, airlaying, as well as other processes known in the art. For hydroentangled material, the percentage of pulp is about 70 to 85 percent.

Also suitable for articles of the present disclosure are fibrous sheets that are pattern densified or imprinted, such as the fibrous sheets disclosed in any of the following U.S. Pat. Nos. 4,514,345, 4,528,239, 5,098,522, 5,260,171, and 5,624,790, the disclosures of which are incorporated herein by reference to the extent they are non-contradictory herewith. Such imprinted fibrous sheets may have a network of densified regions that have been imprinted against a drum dryer by an imprinting fabric, and regions that are relatively less densified (e.g., "domes" in the fibrous sheet) corresponding to deflection conduits in the imprinting fabric, wherein the fibrous sheet superposed over the deflection conduits was deflected by an air pressure differential across the deflection conduit to form a lower-density pillow-like region or dome in the fibrous sheet.

The fibrous web can also be formed without a substantial amount of inner fiber-to-fiber bond strength. In this regard, the fiber furnish used to form the base web can be treated with a chemical debonding agent. The debonding agent can be added to the fiber slurry during the pulping process or can be added directly to the headbox. Suitable debonding agents that may be used in the present disclosure include cationic debonding agents such as fatty dialkyl quaternary amine salts, mono fatty alkyl tertiary amine salts, primary amine salts, imidazoline quaternary salts, silicone, quaternary salt and unsaturated fatty alkyl amine salts. Other suitable debonding agents are disclosed in U.S. Pat. No. 5,529,665, which is incorporated herein by reference in a manner consistent herewith.

While the creped webs of the present disclosure have high strike-through resistance, such greater than about 2 seconds, and more preferably greater than about 5 seconds, without post treatment, the webs may, in certain embodiments, be post treated to provide additional benefits. The types of chemicals that may be added to the web include absorbency aids usually in the form of cationic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin-E, silicone, lotions in general, and the like, may also be incorporated into the finished products. Such chemicals may be added at any point in the web forming process.

Fibrous webs that may be treated in accordance with the present disclosure may include a single homogenous layer of fibers or may include a stratified or layered construction. For instance, the fibrous web ply may include two or three layers of fibers. Each layer may have a different fiber composition. For example a three-layered headbox generally includes an upper head box wall and a lower head box wall. Headbox further includes a first divider and a second divider, which separate three fiber stock layers.

Each of the fiber layers comprises a dilute aqueous suspension of papermaking fibers. The particular fibers contained in each layer generally depend upon the product being formed and the desired results. For instance, the fiber composition of each layer may vary depending upon whether a bath tissue product, facial tissue product or paper towel is being produced. In one aspect, for instance, the middle layer contains southern softwood kraft fibers either alone or in combination with other fibers such as high yield fibers. Outer layers, on the other hand, contain softwood fibers, such as northern softwood kraft. In an alternative aspect, the middle layer may contain softwood fibers for strength, while the outer layers may comprise hardwood fibers, such as eucalyptus fibers, for a perceived softness.

In general, any process capable of forming a base sheet may be utilized in the present disclosure. For example, an endless traveling forming fabric, suitably supported and driven by rolls, receives the layered papermaking stock issuing from the headbox. Once retained on the fabric, the layered fiber suspension passes water through the fabric. Water removal is achieved by combinations of gravity, centrifugal force and vacuum suction depending on the forming configuration. Forming multi-layered paper webs is also described and disclosed in U.S. Pat. No. 5,129,988, which is incorporated herein by reference in a manner that is consistent herewith.

Preferably the formed web is dried by transfer to the surface of a rotatable heated dryer drum, such as a Yankee dryer. In accordance with the present disclosure, the creping composition may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. Creping the web, as it is formed, further reduces internal bonding within the web and increases softness. Applying the creping composition to the web during creping, on the other hand, may increase the strength of the web.

In another embodiment the formed web is transferred to the surface of the rotatable heated dryer drum, which may be a Yankee dryer. The press roll may, in one embodiment, comprise a suction pressure roll. In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In other embodiments, once creped from the dryer drum, the web may be adhered to a second dryer drum. The second dryer drum may comprise, for instance, a heated drum surrounded by a hood. The drum may be heated from about 25° C. to about 200° C., such as from about 100° C. to about 150° C.

In order to adhere the web to the second dryer drum, a second spray device may emit an adhesive onto the surface of the dryer drum. In accordance with the present disclosure, for instance, the second spray device may emit a creping composition as described above. The creping composition not only assists in adhering the tissue web to the dryer drum, but also is transferred to the surface of the web as the web is creped from the dryer drum by the creping blade. Once creped from the second dryer drum, the web may, optionally, be fed around a cooling reel drum and cooled prior to being wound on a reel.

In addition to applying the creping composition during formation of the fibrous web, the creping composition may also be used in post-forming processes. For example, in one aspect, the creping composition may be used during a print-creping process. Specifically, once topically applied to a fibrous web, the creping composition has been found wellsuited to adhering the fibrous web to a creping surface, such as in a print-creping operation.

For example, once a fibrous web is formed and dried the creping composition may be applied to at least one side of the web and the at least one side of the web may then be creped. In general, the creping composition may be applied to only one side of the web and only one side of the web may be creped, the creping composition may be applied to both sides of the web and only one side of the web is creped, or the creping composition may be applied to each side of the web and each side of the web may be creped.

In one embodiment the creping composition may be added to one side of the web by creping, using either an in-line or off-line process. A tissue web is passed through a first creping composition application station that includes a nip formed by a smooth rubber press roll and a patterned rotogravure roll. The rotogravure roll is in communication with a reservoir containing a first creping composition. The rotogravure roll applies the creping composition to one side of web in a preselected pattern. The web is then contacted with a heated roll, which can be heated to a temperature, for instance, up to about 200° C., and more preferably from about 100° C. to about 150° C. In general, the web can be heated to a temperature sufficient to dry the web and evaporate any water. It should be understood, that besides the heated roll, any suitable heating device can be used to dry the web. For example, in an alternative embodiment, the web can be placed in communication with an infra-red heater in order to dry the web. Besides using a heated roll or an infra-red heater, other heating devices can include, for instance, any suitable convective oven or microwave oven.

From the heated roll, the web can be advanced by pull rolls to a second creping composition application station, which includes a transfer roll in contact with a rotogravure roll, which is in communication with a reservoir containing a second creping composition. The second creping composition may be applied to the opposite side of the web in a preselected pattern. The first and second creping compositions may contain the same ingredients or may contain different ingredients. Alternatively, the creping compositions may contain the same ingredients in different amounts as desired. Once the second creping composition is applied the web is adhered to a creping roll by a press roll and carried on the surface of the creping drum for a distance and then removed therefrom by the action of a creping blade. The creping blade performs a controlled pattern creping operation on the second side of the tissue web. Although the creping composition is being applied to each side of the tissue web, only one side of the web undergoes a creping process. It should be understood, however, that in other embodiments both sides of the web may be creped.

Once creped the tissue web may be pulled through a drying station. The drying station can include any form of a heating unit, such as an oven energized by infra-red heat, microwave energy, hot air, or the like. A drying station may be necessary in some applications to dry the web and/or cure the creping composition. Depending upon the creping composition selected, however, in other applications a drying station may not be needed.

The creping compositions of the present disclosure are typically transferred to the web at high levels, such that at least about 30 percent of the creping composition applied to the Yankee dryer is transferred to the web, more preferably at least about 45 percent is transferred and still more preferably at least about 60 percent is transferred. Generally from about 45 to about 65 percent of the creping composition applied to the Yankee dryer is transferred to the web. Thus, the amount of creping additive transferred to the sheet is a function of the amount of creping additive applied to the Yankee dryer.

The total amount of creping composition applied to each side of the web can be in the range of from about 0.1 to about 10 percent by weight, based upon the total weight of the web, such as from about 0.3 to about 5 percent by weight, such as from about 0.5 to about 3 percent by weight. To achieve the desired additive application levels the add on rate of creping composition to the dryer, measured as mass (i.e., mg) per unit area of dryer surface (i.e., $m^2$), may range from about 50 to about 300 $mg/m^2$, and still more preferably from about 100 to about 200 $mg/m^2$.

Further, the creping composition is applied to the paper web so as to cover from about 15 to about 100 percent of the surface area of the web. More particularly, in most applications, the creping composition will cover from about 20 to about 60 percent of the surface area of each side of the web.

In one aspect, fibrous webs made according to the present disclosure can be incorporated into multiple-ply products. For instance, in one aspect, a fibrous web made according to the present disclosure can be attached to one or more other fibrous webs for forming a wiping product having desired characteristics. The other webs laminated to the fibrous web of the present disclosure can be, for instance, a wet-creped web, a calendered web, an embossed web, a through-air dried web, a creped through-air dried web, an uncreped through-air dried web, an airlaid web, and the like.

In one aspect, when incorporating a fibrous web made according to the present disclosure into a multiple-ply product, it may be desirable to only apply the creping composition to one side of the fibrous web and to thereafter crepe the treated side of the web. The creped side of the web is then used to form an exterior surface of a multiple-ply product. The untreated and uncreped side of the web, on the other hand, is attached by any suitable means to one or more plies.

In multiple-ply products, the basis weight of each fibrous web present in the product may vary. In general, the total basis weight of a multiple-ply product will generally be from about 30 to about 60 gsm, such as from about 32 to about 45 gsm, and more preferably from about 35 to about 40 gsm. In particularly preferred embodiments the tissue product is a multi-ply facial tissue wherein each ply has a basis weight from about 15 to about 30 gsm, such as from about 16 to about 22.5 gsm, and more preferably from about 17.5 to about 20 gsm.

In addition to having increased basis weights, tissue sheets made according to the present disclosure may possess a desirable water absorption rate. Tissue sheets prepared as set forth herein generally have a Wet Out time that is at least 2 times longer (measured as described below in the test methods section) compared to tissue prepared using conventional creping chemistries. Accordingly, in certain embodiments, tissue products of the present disclosure have Wet Out times greater than about 10 seconds, and more preferably greater than about 15 seconds and more preferably greater than about 20 seconds.

In other embodiments tissue sheets made according to the present disclosure, and products formed therefrom, have good strike-through resistance, such that the HST values are generally greater than about 2 seconds, more preferably greater than about 4 seconds and still more preferably greater than about 6 seconds. The desired strike-through resistance is achieved even at higher basis weights, such that webs and products prepared according to the present disclosure have an HST value greater than about 2 seconds. Even the basis weight of the web, or any single web within a multi-ply product, is greater than about 16 gsm.

Moreover, the improved strike-through resistance is achieved without negatively effecting absorbent capacity. As such, tissue products prepared according to the present disclosure have an absorbent capacity greater than about 27 g, such as from about 27 to about 35 g.

TEST METHODS

Strike Through Resistance

Strike through resistance is measured by the Hercules Size Test (HST), which generally measures how long it takes for a liquid to travel through a tissue product (strike-through). Hercules Size Testing is done in general accordance with TAPPI method T 530 PM-89, Size Test for Paper with Ink Resistance using a Model HST tester with white and green calibration tiles and the black disk provided by the manufacturer. A 2 percent Napthol Green N dye diluted with distilled water to 1 percent is used as the dye.

Six (6) tissue sheets (18 plies for a 3-ply tissue product, 12 plies for a two-ply product, 6 plies for a single ply product, etc.) form the specimen for testing. All specimens were conditioned for at least 4 hours at 23±1° C. and 50±2% relative humidity prior to testing. Specimens are cut to an approximate dimension of 2.5×2.5 inches. The specimen (12 plies for a 2-ply tissue product) is placed in the sample holder with the outer surface of the plies facing outward. The specimen is then clamped into the specimen holder. The specimen holder is then positioned in the retaining ring on top of the optical housing. Using the black disk, the instrument zero is calibrated. The black disk is removed and 10±0.5 mm of dye solution is dispensed into the retaining ring and the timer started while placing the black disk back over the specimen. The test time in seconds (sec.) is recorded from the instrument.

Absorbent Capacity

Absorbent capacity is determined by first cutting 20 sheets of a sample, each sheet measuring 3"×3" and stapling the 20 sheets together at the edges to form a test specimen. A test specimen is then weighed. The weighed specimen is then soaked in a pan of test fluid (e.g. paraffin oil or water) for three minutes. The test fluid should be at least 2 inches (5.08 cm) deep in the pan. The specimen is removed from the test fluid and allowed to drain while hanging in a "diamond" shaped position (i.e. with one corner at the lowest point). The specimen is allowed to drain for three minutes for water and for five minutes for oil. After the allotted drain time the specimen is placed in a weighing dish and then weighed. Absorbent Capacity (g)=wet weight (g)−dry weight (g) and Specific Absorbent Capacity (g/g)=Absorbent Capacity (g)/dry weight (g).

Wet-Out Time

The "Absorbency Rate (Wet-Out Time) Test" is used to determine the absorbency wet out time. To carry out the test, the test product is first equilibrated to ambient conditions for at least four hours at 23±3° C. and 50±5% relative humidity. Twenty (20) sheets are stacked and cut to a 60×60 mm (±3 mm) square using a device capable of cutting to the specified dimensions such as a Hudson Machinery, or equivalent. The square is then fixed in each corner by staples delivered by a standard, commercially available manual office stapler. The staples are placed diagonally across each corner far enough into the sheet so that the staples are completely contacting the tissue sheets, staples should not wrap the corner of the sample. The sample is then held horizontally and approximately 25 mm (1 inch) over a container containing distilled or de-ionized water at 23±3° C. The container is of sufficient size and depth to ensure that the saturated specimen does not contact the sides, bottom of the container, and the top surface of the water at the same time. The container contains a minimum depth of 51 mm of water to ensure complete saturation of the test specimen and this depth should be maintained throughout the testing. The specimen is then dropped flat onto the water surface and a timing device is started when the specimen contacts the water surface. As soon as the specimen is completely saturated, the timing device is stopped and Wet Out time is recorded in seconds.

EXAMPLES

Inventive sample codes were made using a wet pressed process utilizing a Crescent Former. Initially, northern softwood kraft (NSWK) pulp was dispersed in a pulper for 30 minutes at 4 percent consistency at about 100° F. The NSWK pulp was then transferred to a dump chest and subsequently diluted to approximately 3 percent consistency. The NSWK pulp was refined at about 1 HP-days/MT. Softwood fibers were then pumped to a machine chest where they were mixed with 2 kg/MT of Kymene® 920A (Ashland Water Technologies, Wilmington, Del.) and 1 kg/MT Baystrength 3000 (Kemira, Atlanta, Ga.) prior to the headbox. The softwood fibers were added to the middle side layer in the 3-layer tissue structure. The virgin NSWK fiber content contributed approximately 32 percent of the final sheet weight.

Eucalyptus hardwood kraft (EHWK) pulp was dispersed in a pulper for 30 minutes at about 4 percent consistency at about 100° F. The EHWK pulp was then transferred to a dump chest and subsequently diluted to about 3 percent consistency. The EHWK pulp fibers were then pumped to a machine chest where they were mixed with 2 kg/MT of Kymene® 920A. These fibers were added to the dryer, middle and felt layers, as indicated in Table 2.

TABLE 2

| Layer | Fiber Type | Additives | Weight % (total web) |
|---|---|---|---|
| Dryer | EHWK | 2 kg/MT Kymene ® 920A | 44 |
| Middle | NSWK | 2 kg/MT Kymene ® 920A<br>1 kg/MT Baystrength ™ 3000 | 32 |
| Felt | EHWK | 2 kg/MT Kymene ® 920 A | 24 |

The pulp fibers from the machine chests were pumped to the headbox at a consistency of about 0.1 percent. Pulp fibers from each machine chest were sent through separate manifolds in the headbox to create a 3-layered tissue structure. The fibers were deposited onto a felt using a Crescent Former.

The wet sheet, about 10 to 20 percent consistency, was adhered to a Yankee dryer, traveling at about 2000 fpm (610 mpm) through a nip via a pressure roll. The consistency of the wet sheet after the pressure roll nip (post-pressure roll consistency or PPRC) was approximately 40 percent. The wet sheet is adhered to the Yankee dryer due to the creping composition that was applied to the dryer surface. A spray boom situated underneath the Yankee dryer sprayed the creping composition onto the dryer surface.

Three different creping compositions were evaluated. A conventional creping composition comprising, by weight on a solids basis, 70 percent Crepetrol™ Xcel and 30 percent Crepetrol™ 874 (both commercially available from Ashland Water Technologies, Wilmington, Del.) was prepared at about 1 percent solids. The flow rates of the conventional creping chemistry were varied to deliver a total addition of about 10 $mg/m^2$ spray coverage on the Yankee Dryer at the desired component ratio.

The second creping composition comprised a non-fibrous olefin dispersion, sold under the trade name HYPOD 8510 (Dow Chemical Co., Midland, Mich.). The HYPOD 8510 was prepared at 30 percent solids and delivered at a total addition of about 200 mg/m$^2$ spray coverage on the Yankee Dryer.

A water soluble creping composition comprising Glucosol™ 800 (Chemstar, Minneapolis, Minn.), Carbowax™ PEG 8000 (Dow Chemical Co., Midland, Mich.) and Polyox™ N80 (Colorcon, Inc., West Point, Pa.) was prepared by dissolution of the solid polymers into water followed by stirring until the solution was homogeneous. Each polymer was dissolved and pumped separately to the process. Glucosol™ 800 was prepared at 5% solids, Polyox™ N80 was prepared at 2.5% solids and Carbowax™ PEG 8000 was prepared at 10% solids. The flow rates of the individual components were varied to deliver a total addition of 225 mg/m$^2$ spray coverage on the Yankee Dryer at the desired component ratio.

TABLE 3

| Creping Composition | 1$^{st}$ Creping Component (wt %) | 2$^{nd}$ Creping Component (wt %) | 3$^{rd}$ Creping Component (wt %) | Total (Addition (mg/m$^2$) |
|---|---|---|---|---|
| Conventional | Crepetrol ™ Xcel (70%) | Crepetrol ™ 874 (30%) | — | 10 |
| Water Soluble | Polyox ™ N80 (25%) | Carbowax ™ PEG 8000 (76%) | Glucosol ™ 800 (19%) | 225 |
| Non-fibrous Olefin | HYPOD 8510 | — | — | 200 |

The sheet was dried to about 98 to 99 percent consistency as it traveled on the Yankee dryer and to the creping blade. The creping blade subsequently scraped the tissue sheet and a portion of the creping composition off the Yankee dryer. The creped tissue basesheet was then wound onto a core traveling at about 1575 fpm (480 mpm) into soft rolls for converting. Two soft rolls of the creped tissue were then rewound, calendered, and plied together so that both creped sides were on the outside of the 2-ply structure. Mechanical crimping on the edges of the structure held the plies together. The plied sheet was then slit on the edges to a standard width of approximately 8.5 inches, and cut to facial tissue length. Tissue samples were conditioned and tested.

TABLE 4

| Sample | Creping Chemistry | Add-On (mg/m$^2$) | Wet Out Time (sec) | HST (sec) | Absorbent Capacity (g) | Basis Weight (gsm) |
|---|---|---|---|---|---|---|
| 1 | Conventional | 10 | 3.23 | 0.38 | 40.32 | 37.31 |
| 2 | Conventional | 10 | 2.96 | 0.42 | 39.83 | 33.49 |
| 3 | Conventional | 10 | 3.18 | 0.42 | 33.03 | 30.66 |
| 4 | Water Soluble | 225 | 2.84 | 0.18 | 33.03 | 28.26 |
| 5 | Water Soluble | 225 | 3.24 | 0.22 | 39.83 | 34.09 |

TABLE 4-continued

| Sample | Creping Chemistry | Add-On (mg/m$^2$) | Wet Out Time (sec) | HST (sec) | Absorbent Capacity (g) | Basis Weight (gsm) |
|---|---|---|---|---|---|---|
| 6 | Water Soluble | 225 | 3.38 | 0.20 | 39.88 | 36.58 |
| 7 | Non-fibrous Olefin | 220 | 89.52 | 5.28 | 24.46 | 29.81 |
| 8 | Non-fibrous Olefin | 220 | 85.68 | 6.94 | 29.07 | 34.63 |
| 9 | Non-fibrous Olefin | 220 | 108.81 | 8.40 | 28.88 | 36.32 |

Referring to FIG. 1, the effect of basis weight on strike-through is illustrated for the three different creping compositions of the present example. As can be seen from FIG. 1, there is little or no increase in strike-through as basis weight is increased for tissue webs treated with either a conventional creping composition or a water soluble composition. However, for webs prepared using a non-fibrous olefin creping composition, strike-through increases significantly as basis weight is increased.

The effect of creping composition was further explored by varying the add-on level of the non-fibrous olefin creping composition. Webs were prepared at three different add-on levels, as summarized in the table below.

TABLE 5

| Sample | Creping Chemistry | Add-On (mg/m$^2$) | Wet Out Time (sec) | HST (sec) | Absorbent Capacity (g) | Specific Capacity (g/g) | Basis Weight (gsm) |
|---|---|---|---|---|---|---|---|
| 10 | Non-fibrous Olefin | 100 | 32.48 | 3.48 | 29.60 | 7.45 | 33.22 |
| 11 | Non-fibrous Olefin | 150 | 44.41 | 2.99 | 28.85 | 7.24 | 33.14 |
| 12 | Non-fibrous Olefin | 200 | 35.78 | 2.79 | 30.59 | 7.66 | 33.29 |

Figure 2:
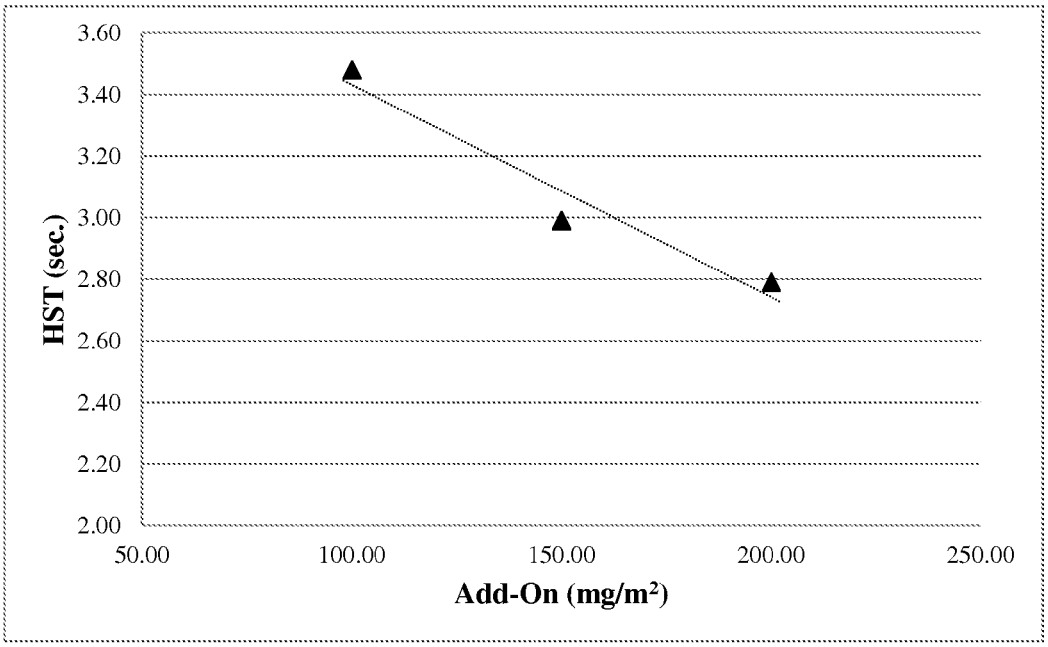
FIG. 2 is a comparison of basis weight (x-axis, grams per square meter) and strike-through (y-axis, seconds) at three different add-on levels of a non-fibrous olefin creping composition.

Referring to FIG. 2, the effect of add-on on strike-through is illustrated for three different add-on levels of the non-fibrous olefin creping composition. As illustrated in FIG. 2, strike-through increases as the non-fibrous olefin add-on is reduced.

Figure 3:
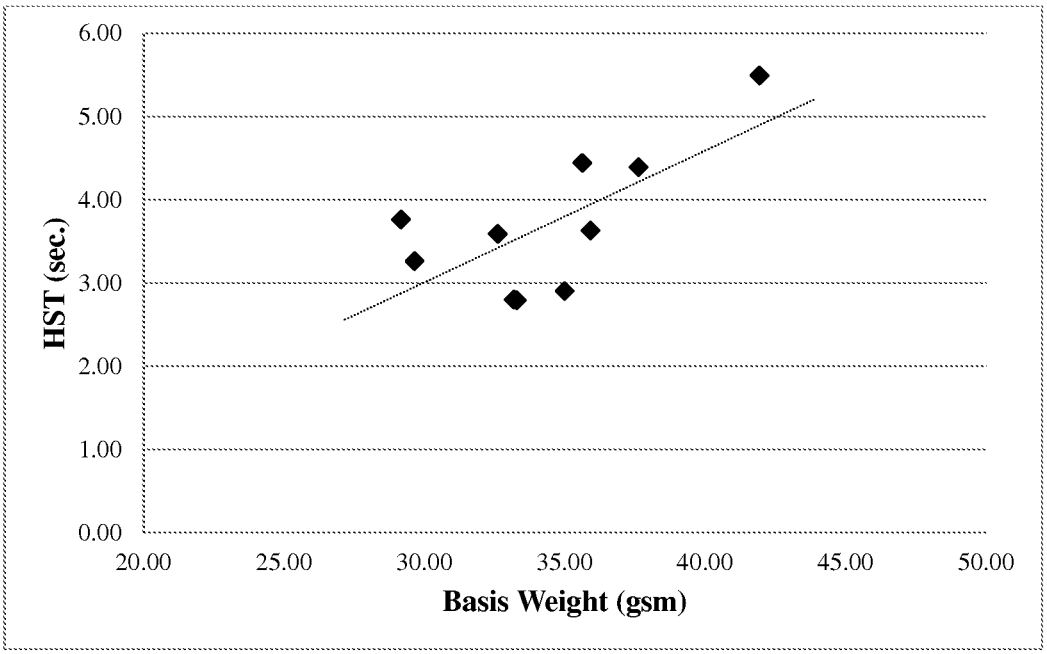
FIG. 3 is a comparison of basis weight (x-axis, grams per square meter) and strike-through (y-axis, seconds) for various webs prepared according to the present disclosure.

To further illustrate the effect of basis weight on strike-through in webs creped using a non-fibrous olefin creping composition, additional webs were prepared as described above wherein the creping composition was added at 200 mg/m$^2$. The webs and their resulting physical properties are summarized in the table below and illustrated in FIG. 3.

TABLE 6

| Sample | Creping Chemistry | Add-On ($mg/m^2$) | Wet Out Time (sec) | HST (sec) | Absorbent Capacity (g) | Specific Capacity (g/g) | Basis Weight (gsm) |
|---|---|---|---|---|---|---|---|
| 13 | Non-fibrous Olefin | 200.00 | 39.75 | 3.26 | 27.67 | 7.75 | 29.65 |
| 14 | Non-fibrous Olefin | 200.00 | 61.47 | 3.76 | 25.80 | 7.37 | 29.16 |
| 15 | Non-fibrous Olefin | 200.00 | 39.47 | 2.80 | 31.08 | 7.75 | 33.19 |
| 16 | Non-fibrous Olefin | 200.00 | 35.78 | 2.79 | 30.59 | 7.66 | 33.29 |
| 17 | Non-fibrous Olefin | 200.00 | 53.52 | 3.59 | 27.56 | 7.07 | 32.61 |
| 18 | Non-fibrous Olefin | 200.00 | 42.57 | 2.90 | 29.62 | 7.09 | 34.99 |
| 19 | Non-fibrous Olefin | 200.00 | 59.35 | 3.63 | 30.55 | 7.13 | 35.91 |
| 20 | Non-fibrous Olefin | 200.00 | 56.08 | 4.44 | 27.58 | 6.46 | 35.62 |
| 21 | Non-fibrous Olefin | 200.00 | 75.41 | 4.39 | 28.03 | 6.23 | 37.62 |
| 22 | Non-fibrous Olefin | 200.00 | 106.41 | 5.49 | 32.28 | 6.45 | 41.92 |

These and other modifications and variations to the present invention may be practiced by those of ordinary skill in the art. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

We claim:

1. A non-post treated creped tissue product comprising two or more tissue webs, wherein the basis weight of each web is from about 16.5 to 20 gsm and the product has a strike-through greater than about 2 seconds and an absorbent capacity greater than about 27 grams, wherein the creped tissue product has not been post-treated with an oil, a wax, a silicone.

2. The creped tissue product of claim 1, wherein the geometric mean tensile of each web is less than about 500 g/3".

3. The creped tissue product of claim 1, wherein the geometric mean tensile of the product is less than about 1000 g/3".

4. The creped tissue product of claim 1, wherein the product has a strike-through greater than about 5 seconds.

5. The creped tissue product of claim 1, wherein the product has a strike-through greater than about 2 to about 10 seconds.

6. The creped tissue product of claim 1, wherein the two or more tissue webs comprise a blend of hardwood fibers and softwood fibers, the hardwood fibers comprising at least about 60 percent and the softwood fibers comprising less than about 40 percent of the total weight of the web.

7. The creped tissue product of claim 1, wherein the two or more tissue webs comprise an inner layer and at least one outer layer contiguous with the inner layer.

8. The creped tissue product of claim 7, wherein the two or more tissue webs comprise an inner layer disposed between two outer layers.

9. The creped tissue product of claim 8, wherein the inner layer comprises softwood fibers and the outer layers comprise hardwood fibers.

10. The creped tissue product of claim 9, wherein the geometric mean tensile of the product is from about 600 to about 1000 g/3".

11. A non-post treated multi-ply tissue product comprising two multi-layered creped tissue webs, the tissue webs having three superposed layers, an inner layer consisting essentially of softwood fibers and two outer layers consisting essentially of hardwood fibers, the inner layer being located between the two outer layers, wherein the product has a basis weight from about 33to about 42 gsm, a strike-through from about 5 to about 10 seconds and an absorbent capacity greater than about 27 grams and has not been post-treated with an oil, a wax, a silicone.

12. A non-post treated tissue product comprising at least two wet-pressed creped tissue webs, each web having a first side and a second side and a creping composition comprising a non-fibrous olefin polymer disposed on at least the first side, wherein each tissue web has a basis weight from about 16.5 to 20 gsm and the product has a strike-through greater than about 2 seconds and an absorbent capacity greater than about 27 grams and has not been post-treated with an oil, a wax, or a silicone.

13. The creped tissue web of claim 12, wherein the geometric mean tensile of each web is from about 300 to about 500 g/3"'.

14. The creped tissue web of claim 12, wherein the product has a strike-through greater than about 2 to about 10 seconds.

15. The creped tissue web of claim 12, wherein the web comprises a blend of hardwood fibers and softwood fibers, the hardwood fibers comprising at least about 60 percent and the softwood fibers comprising less than about 40 percent of the total weight of the web.

16. The creped tissue web of claim 12, wherein the olefin polymer comprises an alpha-olefin interpolymer of ethylene and at least one comonomer selected from the group consisting of a $C_{4-20}$ linear, branched or cyclic diene, vinyl acetate, and a compound represented by the formula $H_2C{=}CHR$, wherein R is a $C_{1-20}$ linear, branched or cyclic alkyl group or a $C_{6-20}$ aryl group, or the alpha-olefin polymer comprises a copolymer of propylene with at least one comonomer selected from the group consisting of ethylene, a $C_{4-20}$ linear, branched or cyclic diene, and a compound represented by the formula $H_2C{=}CHR$, wherein R is a $C_{1-20}$ linear, branched or cyclic alkyl group or a $C_{6-20}$ aryl group.

* * * * *

UNITED STATES PATENT AND TRADEMARK OFFICE

CERTIFICATE OF CORRECTION

PATENT NO. : 8,894,813 B2
APPLICATION NO. : 13/588151
DATED : November 25, 2014
INVENTOR(S) : Kenneth John Zwick et al.

It is certified that error appears in the above-identified patent and that said Letters Patent is hereby corrected as shown below:

IN THE CLAIMS

Column 13, line 30, insert --or-- between wax, and a

Column 14, line 22, insert a space between 33 and to

Column 14, line 25, insert --or-- between wax, and a

Signed and Sealed this
Sixth Day of October, 2015

Michelle K. Lee

Michelle K. Lee
*Director of the United States Patent and Trademark Office*